US006386386B1

(12) United States Patent
George

(10) Patent No.: US 6,386,386 B1
(45) Date of Patent: May 14, 2002

(54) MEDICAL WASTE SEGREGATION APPARATUS WITH MOVEABLE FLOOR

(76) Inventor: Scott A. George, 82 St. John St., Hyannis, MA (US) 02601

( * ) Notice: Subject to any disclaimer, the term of this patent is extended or adjusted under 35 U.S.C. 154(b) by 0 days.

(21) Appl. No.: 09/981,243

(22) Filed: Oct. 16, 2001

Related U.S. Application Data

(63) Continuation-in-part of application No. 09/571,238, filed on May 16, 2000, and a continuation-in-part of application No. 09/356,857, filed on Jul. 19, 1999, now abandoned, which is a continuation-in-part of application No. 09/008,169, filed on Jan. 16, 1998, now abandoned.

(51) Int. Cl.[7] ..... B65D 43/26

(52) U.S. Cl. ..... 220/526; 220/263; 220/523; 220/909

(58) Field of Search ..... 220/530, 526, 220/523, 909, 263

(56) References Cited

U.S. PATENT DOCUMENTS

| | | | | | |
|---|---|---|---|---|---|
| 2,895,782 | A | * | 7/1959 | Fragle | 220/909 X |
| 3,958,715 | A | * | 5/1976 | Capelli | 220/909 X |
| 5,005,727 | A | * | 4/1991 | Roth | 220/909 X |
| 5,072,852 | A | * | 12/1991 | Smith et al. | 220/909 X |
| 5,303,841 | A | * | 4/1994 | Mezey | 220/909 X |
| 5,388,697 | A | * | 2/1995 | James | 206/459.5 |
| 5,662,235 | A | * | 9/1997 | Nieto | 220/909 X |

FOREIGN PATENT DOCUMENTS

| | | | | |
|---|---|---|---|---|
| DE | 2453714 | * | 5/1976 | 206/495.5 |
| FR | 779231 | * | 4/1935 | 220/578 |
| GB | 2046583 | * | 11/1980 | 220/578 |
| NO | 72047 | * | 5/1947 | 220/578 |

* cited by examiner

*Primary Examiner*—Stephen P. Garbe
*Assistant Examiner*—Joseph C. Merek
(74) *Attorney, Agent, or Firm*—Thomas A. Kahrl, Esq

(57) ABSTRACT

A Medical Waste Segregation Apparatus and Method for segregating medical waste at the point of disposal within a medical facility in preparation for further segregated disposal outside the facility. The medical waste device is divided in half by a vertical plane extending through the mid point thereof and with color coding; i.e., one half red and one half neutral, for easy recognition by busy medical staff to deposit red medical waste in the red sector at the point of generation of such waste, whereby cost savings are available for recyclable general waste in the form of cost avoidance as well as seeking to eliminate commingling of general waste inadvertently with medical waste, to achieve decreased disposal cost and increased opportunity for cost avoidance.

6 Claims, 6 Drawing Sheets

MEDICAL WASTE SEGREGATION APPARATUS WITH MOVEABLE FLOOR

CROSS-REFERENCE TO RELATED APPLICATIONS

This application is a continuation-in-part of Ser. No. 09/008,169, entitled MEDICAL WASTE SEGREGATION APPARATUS AND METHOD, filed on Jan. 16, 1998, now abandoned, Ser. No. 09/356,857 entitled MEDICAL WASTE SEGREGATION APPARATUS AND METHOD, filed on Jul. 19, 1999 now abandoned, and Ser. No. 09/571,238 entitled MEDICAL WASTE SEGREGATION APPARATUS WITH MOVEABLE FLOOR filed on May 16, 2000, of Scott A. George, and which are incorporated herein by reference

BACKGROUND OF THE INVENTION

1. Field of the Invention (Technical Field)

The present invention relates to waste segregation apparatus for use in hospitals and medical facilities for segregating medical waste at the point of disposal within such a facility in preparation for further segregated disposal outside the facility. More specifically it relates to an arrangement having two uniquely identified and separately divided waste receiving cavities in a unitary container under a unitary divider lid operated by a foot pedal, each cavity having a moveable floor.

2. Background Prior Art

Applicant is aware of prior art waste receptacle devices. For example U.S. Pat. No. 4,913,308 to Culbertson shows a waste receptacle unit employing a liner retainer being provided for retaining the mouth of a flexible liner bag in an open position for receiving objects in the bag.

The following six U.S. PATENTS relate to garbage and waste receptacles having hinged foot activated mechanisms for opening and closing the lid: U.S. Pat. No. 1,174,136 to Filger relates to containers designed to provide airtight closures for such garbage receptacles as are to be placed therein; U.S. Pat. No. 1,714,332 to Ullrich relates to garbage and waste receptacles, and more particularly to improvements in the operating devices for their closures; U.S. Pat. No. 4,953,740 to Koda relates to a wastebasket having lid hinge and actuating mechanism protector; U.S. Pat. No. 4,972,966 to Craft, Jr. relates to a step-on wastebasket; U.S. Pat. No. 5,163,574 to Sosan relates to a pedal trash receptacle intended for use in public places; and U.S. Pat. No. 5,249,693 to Gillispie et al. relates to a plastic waste can for oily waste.

The following five U.S. PATENTS relate to waste containers with multiple compartments: U.S. Pat. No. 1,174,136 to Filger; U.S. Pat. No. 4,974,746 to Dickinson relates to a waste separation container; U.S. Pat. No. 5,033,641 to Martin relates to a refuse container with multi-position divider; U.S. Pat. No. 5,090,785 to Stamp relates to a multi-compartment container; and U.S. Pat. No. 5,277,312 to Vumbaca relates to a syringe container which holds both sterile and soiled syringes, separated by a dividing plate.

The following two U.S. PATENTS relate to waste supports for trash containers: U.S. Pat. No. 5,085,342 to Strawder relates to a bag support for trash cans; and U.S. Pat. No. 5,348,222 to Patey relates to a garbage container including a horizontally pivoting waste supporting platform within the housing.

Background

Disposal of bio-hazardous waste, hereinafter described as medical waste, has become very expensive for medical facilities. For example, the disposal cost of medical waste, defined as wet/saturated with blood and/or body fluids, is $500.00 per ton, whereas the disposal of general waste is only $50.00 per ton. Furthermore, cost savings are available for recyclable general waste in the form of cost avoidance. However when general waste items are inadvertently commingled with medical waste, not only is the disposal cost increased, but the cost avoidance opportunity is lost.

In the past, attempts have been made to provide disposal arrangements for segregation of medical waste, just as there have been attempts to recycle household trash. Each of these attempts has taken a long time to take hold, and as of yet still show only partial participation. However, a particular problem in the medical waste disposal arrangement is that conditions in those facilities that generate medical waste generally place a priority on matters other than segregation of trash, particularly in operating rooms and emergency facilities. As a result, general waste gets commingled with medical waste, as operators do not have the time to take those extra mental steps to properly segregate the medical waste from general waste.

Accordingly, there is a need in the waste receptacle art for a new and improved arrangement for reinforcing the principles of segregation by limiting disposal arrangements to a unitary two-in-one container which is color coded for ease of disposal of multiple classes of waste to provide for savings in the disposal of medical waste which overcomes at least some of the disadvantages of prior art.

The following is an example of recycling programs and their financial impact for a typical 180 bed hospital:

1) Mixed paper: The sample hospital typically recycles 7,000 pounds of paper per month. If it were to throw that paper away it would cost $48.00 per 2,000 pounds, which equals $168.00 per month or $2,016.00 per year. In addition, at each pickup the hospital would also have to pay a hauling or pickup fee of $150.00. At the hospital's current rate of paper recycling, haulage for the paper would cost $250.00 per month or $2,700 per year. Total projected yearly savings on mixed paper: $4,716.00.

2) Cardboard: The hospital typically recycles 18,000 pounds of cardboard per month. By recycling the cardboard it can attain a cost avoidance that is figured the same way as the paper savings. It would cost $432.00 per month and $5,184.00 per year to throw the cardboard away. It would also cost $750.00 per month and $9,000.00 per year to have it hauled away. Total projected yearly savings on cardboard: $14,184.00

3) Program for Sorting and Separating Medical and General Waste: The hospital's program is tied into both "plastics" and "red bag trash". In the waste stream are two basic classifications of trash, bio-hazardous and regular. In the regular trash are found 80% of the recyclable material. It is assumed that large amounts of plastics are being tossed into their bio-hazardous, or red bag, trash. Once this happens the hospital is unable to retrieve the plastics for possible recycling. The solution to this problem is to educate its staff on proper separation and disposal of its red bag and regular trash. Disposal of regular trash is $48.00 a ton and $150.00 per haul. The red bag trash cost is a flat rate of $7.62 per container (40–65 pounds per container).

The sorting and separating program is directed to an operating room where there is the largest amount of red bag trash and where the area is controlled. The sample operating room had been filling 125 containers of red bag trash per week on the day shift. Once the sorting and separating program was commenced that number was reduced to only five containers per week. This added up to a savings of $914.40 per week and an annual savings of $47,548.80 for the year. The sample Biohazard waste hauler pickups could be reduced from 2–3 times a week to one time per week. The total projected yearly savings for mixed paper, cardboard, and the segregation of red bag trash at the sample hospital: $114,511.00.

The hospital in this example can see recycling playing a huge part in its waste management for the future. By state mandate, landfills are being capped. Residents are required to separate household trash before bringing it to local landfills and in the future may be asked to pay for all non-separated and non-recyclable waste. The next step may be a mandate to all large employers, including hospitals, to recycle a certain percentage of their waste stream. The program this sample hospital has already put into effect will benefit it both now and in the future.

The present invention overcomes the limitations of the prior technology expressed above by providing improved arrangements for segregation of medical waste for use in hospitals and medical facilities. More specifically the present invention was directed to an arrangement for reinforcing the principles of segregation by limiting disposal arrangement to a unitary two-in-one container which is color coded for ease of disposal.

SUMMARY OF THE INVENTION

The present invention is directed to providing improved refuse disposal arrangements for use in hospitals and medical facilities for achieving substantial cost savings. In particular the present invention relates to waste segregation apparatus for segregating medical waste at the point of disposal within such a facility in preparation for further segregated disposal outside the facility. More specifically it relates to an arrangement having two uniquely identified and separately divided waste receiving cavities, each cavity having a moveable floor, in a unitary container under a unitary divider lid operated by a foot pedal.

A particular advantage of the present invention is that it provides a means for reinforcing the principles of segregation by limiting disposal arrangement in such facilities to a unitary two-in-one container which is color coded for ease of disposal. Cost savings are available for (a) recyclable general waste in the form of cost avoidance by eliminating commingling of general waste inadvertently with medical waste, to achieve (b) decreased disposal cost and (c) increased opportunity for cost avoidance.

The present invention is particularly directed to providing two uniquely identified and separately divided waste receiving cavities under one divider lid, operated by a foot pedal. In the specific arrangement of the invention one of the cavities is color coded red for medical waste such as found in medical facilities, and the other cavity is neutral (neutral being defined as non-red) for general waste which may include recyclable materials. Each cavity is lined with a separate disposable bag and each cavity employs a separate moveable floor, each moveable between an extended long bag position and a retracted, short bag position. The positioning of the moveable floor in respect to receptacle internal walls is determined by the size of bag selected, which in turn is determined by the waste usage of the locale of the waste container. An advantage of the C is that it provides for leveling of unequal bags in a unitary container for containing unequal amounts of medical and general trash material. Each moveable floor member includes a pair of outwardly extending tabs mounted on a slide block. Said tabs are spring loaded for biasing each tab in an extended position. Each tab includes a finger hole to be manually accessed for moving said tab between an extended engaged position to a retracted, moveable position permitting each moveable floor member to be disengaged from a first position and moved to a second position. In operation the finger holes of a moveable floor member are manually grasped between thumb and forefinger and urged together to a position whereby the pair of tabs are retracted inwardly from an extended position to a retracted position from a support member such as shelf cleats. In such retracted position the moveable floor member may be moved from a first position to a second position whereupon pressure on the finger holes may be released such that the tabs move outwardly to an extended position in engagement with a support, i.e., shelf cleats.

In the present invention, a barrier is provided adapted to provide a barrier throughout the full open and closed modes of operation of the lid. The barrier apparatus according to the invention may also include a sandwich channel portion into which the barrier wall extends when it is properly received therein. The purpose of the barrier on the lid is to insure that there is no inadvertent commingling of waste .

Inasmuch as the device employs a moveable floor permitting adjustment of the respective cavity to the size of disposal bag in said cavity, a user may selectably place the device in any department of the facility and make adjustments to the cavity size according to the waste flow of that department. The unitary trash container according to the invention may also include a lid and lid raising mechanism. The lid is preferably pivotally connected on one side of the receptacle outside of the perimeter of the deposit opening and retainer channel, near the outer channel wall. The lid is adapted to pivot between an open position in which the receptacle deposit opening is exposed for receiving trash, and a closed position covering the deposit opening of the trash receptacle compartment.

The present invention further is directed to a method for segregating medical waste from general recyclable trash. In order to facilitate segregation, the method includes the following steps for reinforcing segregation;

1) providing unitary receptacle means for accepting and segregating the deposit of multiple classes of trash in each room;
2) providing dual compartment means for segregated containment of the segregated contents,
3) providing color coding means for segregating waste;
4) providing barrier means for providing a barrier throughout the open and closed mode; and
5) providing collection means for segregated collection of the contents of the receptacle means. The method of the device is to reinforce the simplicity of properly disposing of medical waste. By properly disposing of the medical waste, the user will reduce their waste disposal costs at the point of origin.

It is a general object of the present invention to provide a medical waste segregation device for segregating medical waste at the point of disposal within a medical facility in preparation for further segregated disposal outside the facility.

More particularly, it is an object of the invention to provide a waste container apparatus divided into dual compartments having a remotely operated top, an internal divider mechanism, all of which are color coded red or neutral depending on where each part is positioned, i.e. red if in the red medical waste half or neutral in the other half.

Another object of the invention is to provide a disposal apparatus divided into dual compartments for receiving plastic trash bags, each having a moveable floor, and each color coded red and neutral respectively, wherein said compartments are divided at the mid point by a lid segregator means.

A further object is to provide in each compartment, a moveable bottom to match the compartment size to the bag selected according to a daily usage factor such that the bags are disposed of on a high frequency, i.e. daily.

Yet another object of the invention is to provide a two-in-one trash receptacle typically employing two side-by-side compartments separated by a barrier apparatus which operates to provide a complete barrier at all times between the two compartments.

These and other objects, advantages, and features of the invention will be apparent from the following description of preferred embodiments considered along with the accompanying drawings. The invention will be described for the purpose of illustration only in connection with certain embodiments; however, it is recognized that those persons skilled in the art may make various changes, modifications, improvements and additions on the illustrated embodiments all without departing from the spirit and scope of the invention

BRIEF DESCRIPTION OF THE DRAWINGS

The accompanying drawings, which are incorporated into and form a part of the specification, illustrate several embodiments of the present invention and together with the description serve to explain the principals of the invention. The drawings are only for the purpose of illustrating a preferred embodiment of the invention and are not construed as limiting the invention.

DETAILED DESCRIPTION OF THE PREFERRED EMBODIMENT

Figure 1:
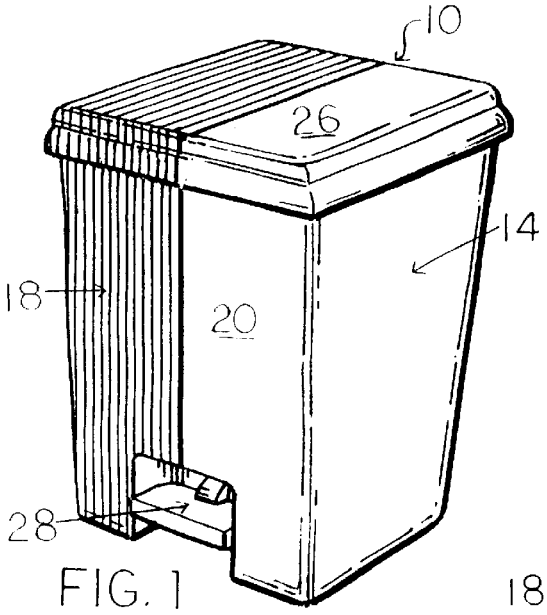
FIG. 1 is a perspective view of the unitary disposal receptacle of the present invention.

Referring to the FIGS. 1–15 , the preferred embodiment is directed to a unitary disposal arrangement 10 comprising a unitary disposal receptacle 14 having a deposit opening 16, at least two uniquely identified and separately divided waste receiving cavities comprising a first cavity 18 and a second cavity 20, each having a depth of 30½". Said first cavity 18 is color coded red for medical waste shown at 12, such as found in medical facilities, and the second cavity 20 is color coded neutral for general waste 13 , which may include recyclable materials, as is shown in FIG. 9.

Figure 2:
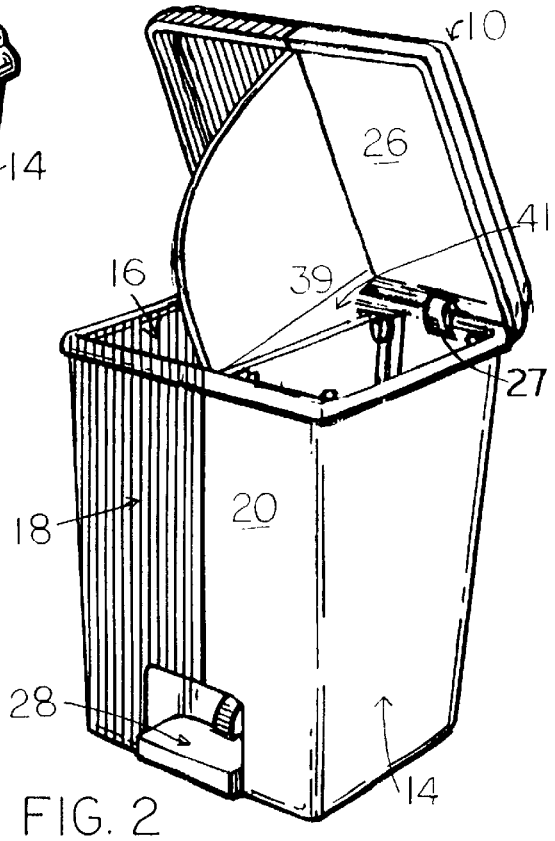
FIG. 2 is a perspective view of the unitary disposal receptacle of FIG. 1 showing the lid open.
Figure 3:
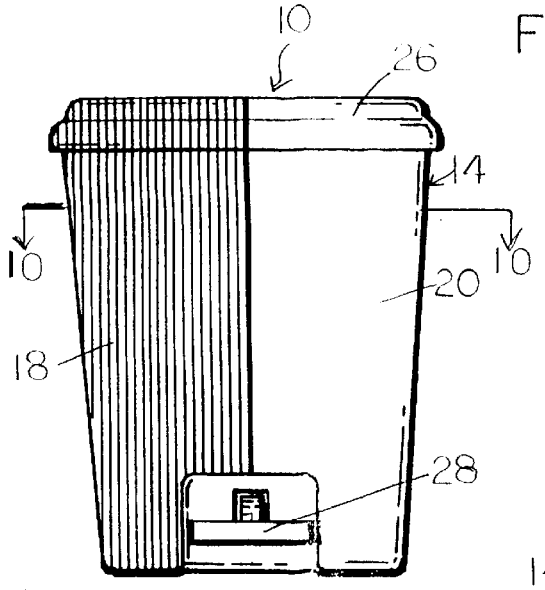
FIG. 3 is a front view of FIG. 1.
Figure 4:
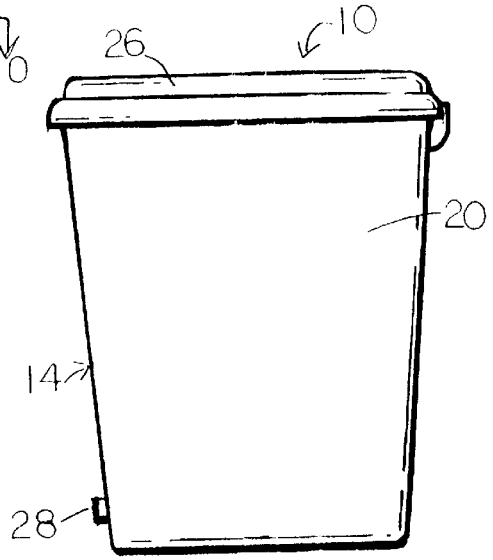
FIG. 4 is a right side view of FIG. 1.
Figure 5:
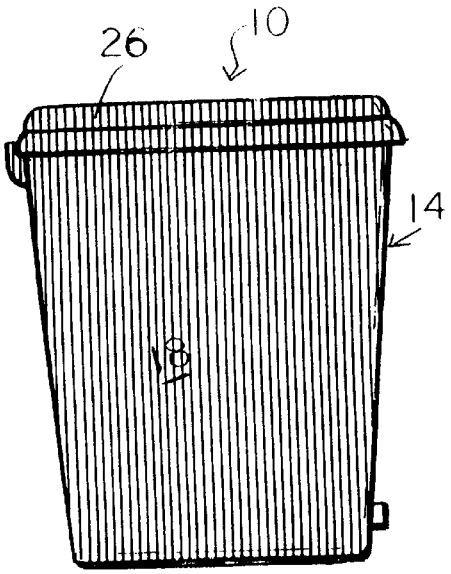
FIG. 5 is a left side view of FIG. 1.
Figure 6:
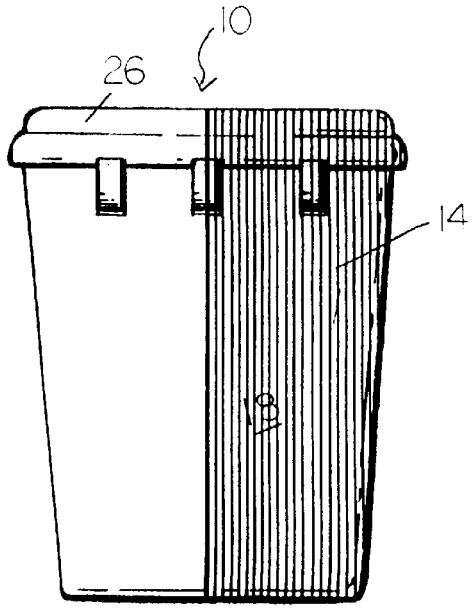
FIG. 6 is a back view of FIG. 1.
Figure 7:
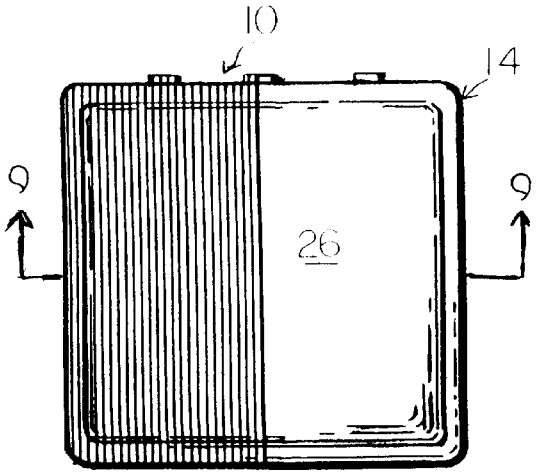
FIG. 7 is a bottom plan view of FIG. 1.
Figure 8:
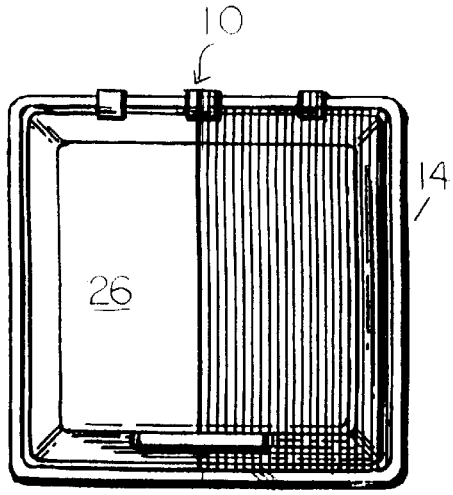
FIG. 8 is a top plan view of FIG. 1.
Figure 9:
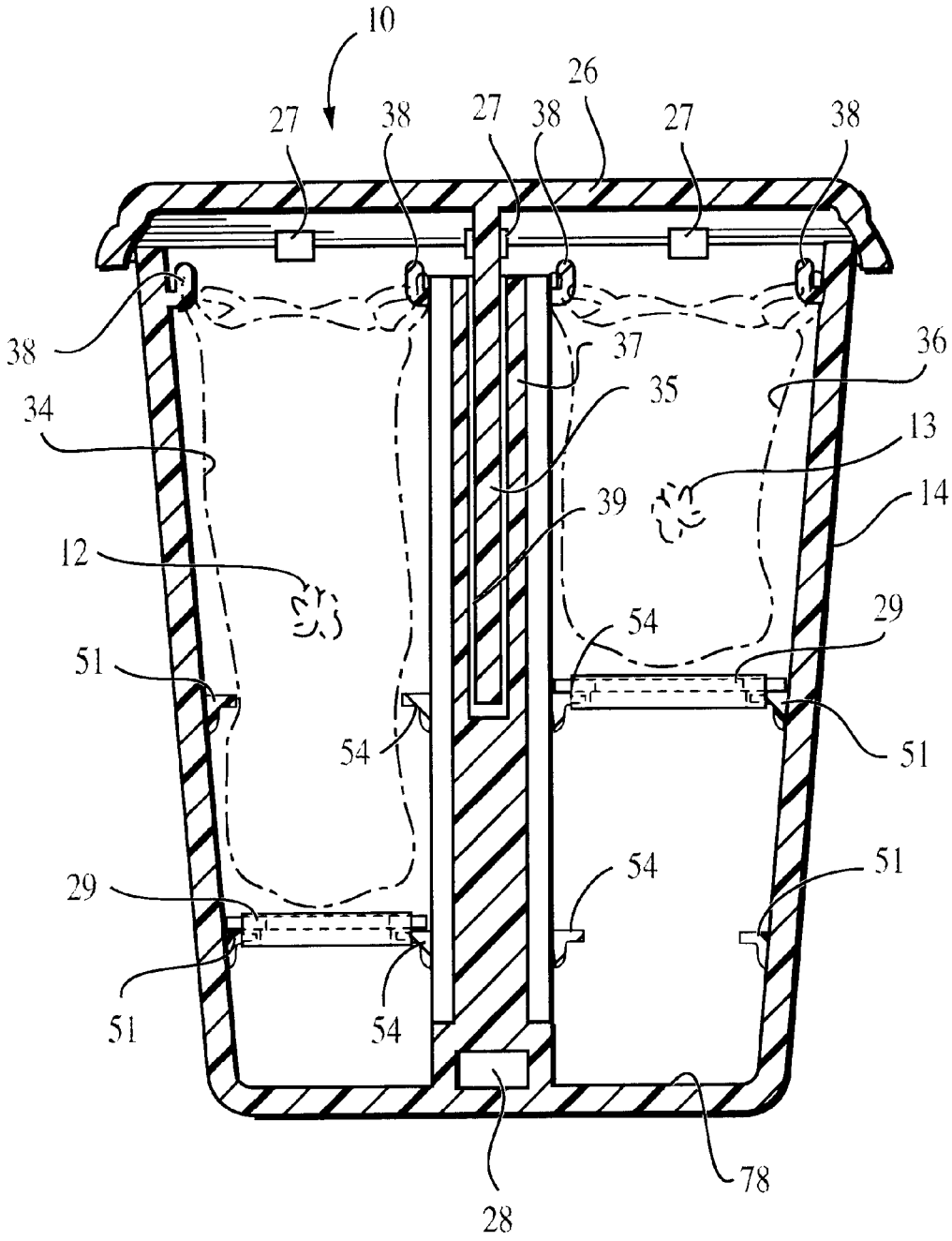
FIG. 9 is a sectional view of FIG. 7 taken along line 9—9
Figure 10:
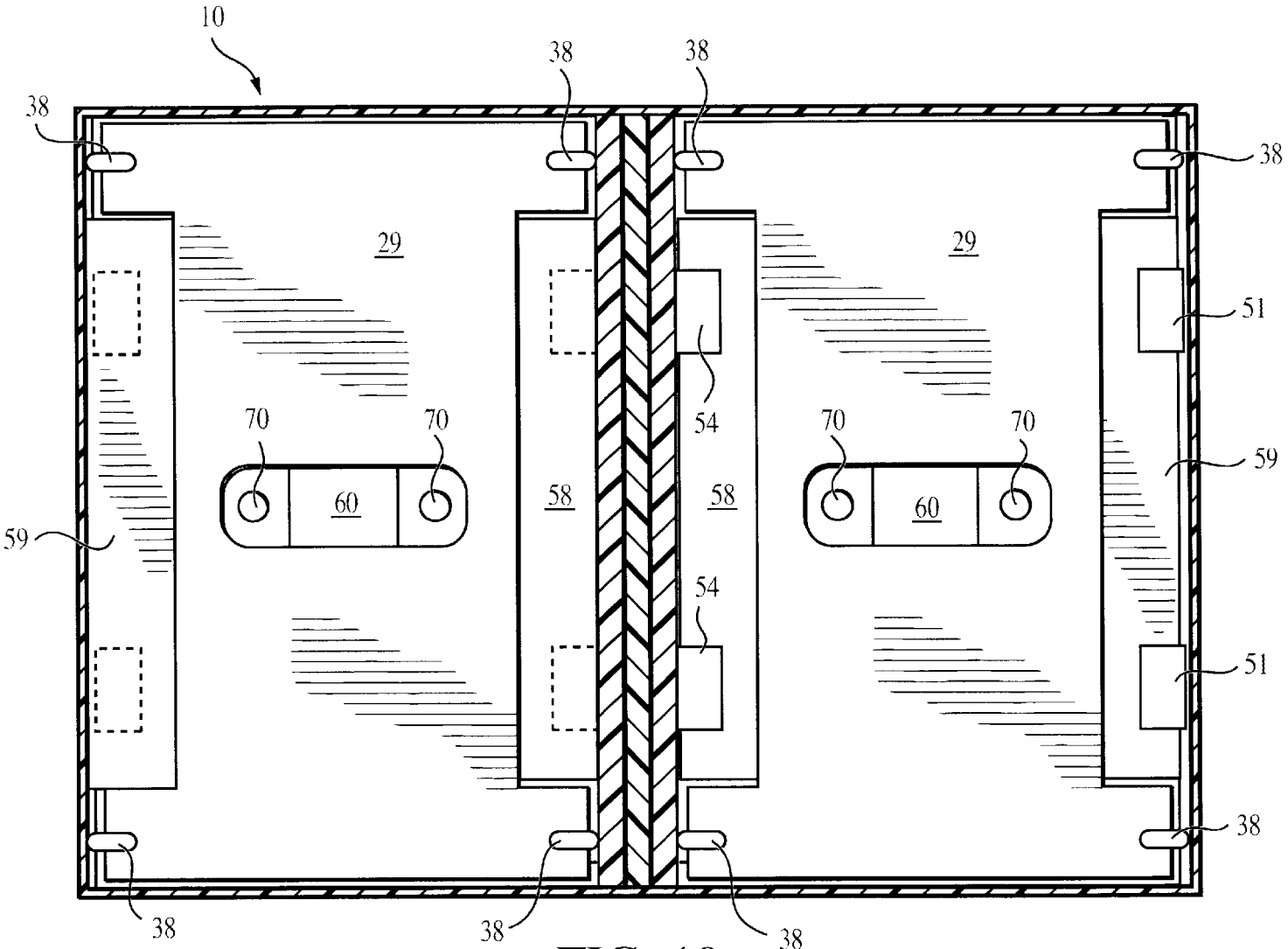
FIG. 10 is a sectional view of FIG. 3 along lines 10—10, including a top view of the moveable floors mounted on shelf cleats with tabs extended.

Referring to FIGS. 1–10, said unitary disposal receptacle 14 comprises a two-in-one container of rectangular cross section with sloping walls having an upper opening of 25" across and a bottom dimension of 20" as is shown in FIG. 10. Said receptacle 14 is divided in half by a vertical intermediate wall member 24 extending through the mid-point of receptacle 14 and is provided with exterior color coding; i.e., one half red and one half neutral. The color coding is a critical feature of the invention as it provides for easy recognition by busy medical staff during surgery on a patient, when seeking to deposit medical waste, not shown. Such waste 12 is colored red by blood released by a patient in the process of surgery and should be deposited in the red cavity 18 at the point of generation of such waste, i.e., during surgery. Said unitary disposal receptacle 14 includes interior wall member 24, positioned between said first cavity 18 and second cavity 20, for separately dividing said cavities, with each cavity having a width of 10" at the upper bag position and 9½" at the lower bag position. Said interior wall member 24 is of sandwich construction, having a hollow, interior channel 37 for associating with a lid barrier member 39, of lid 26 for separately dividing the first cavity 18 from the second cavity 20 during opening of lid 26 as is shown in FIG. 2. Said unitary lid 26 is positioned over said cavities 18 & 20 in hinged relationship supported by hinges 27 as shown in FIG. 6 and operated by a foot pedal 28.

As is shown in FIG. 9, a liner 34 color coded red is arranged in cavity 18, also color coded red, having a mouth 33 for receiving medical waste 12. A second liner 36 color coded neutral is arranged in cavity 20, also color coded neutral, for recyclable waste 13 for the second cavity color coded neutral for recyclable waste. As shown in FIG. 9 there is shown hanger device 38 means for receiving the mouth segment 33 of liners 34 & 36, said hanger being formed on the perimeter of the deposit opening 16.

As is shown in FIG. 9, each cavity 18 & 20 is configured to hold a separate disposable bag 34 and 36 respectively; each cavity has a moveable floor member shown as 29 positioned on shelf cleats 51 and 54 on internal walls 22 to support variable sized bags in a manner such that two bags of unequal size are level with the deposit opening 16.

Figure 11:
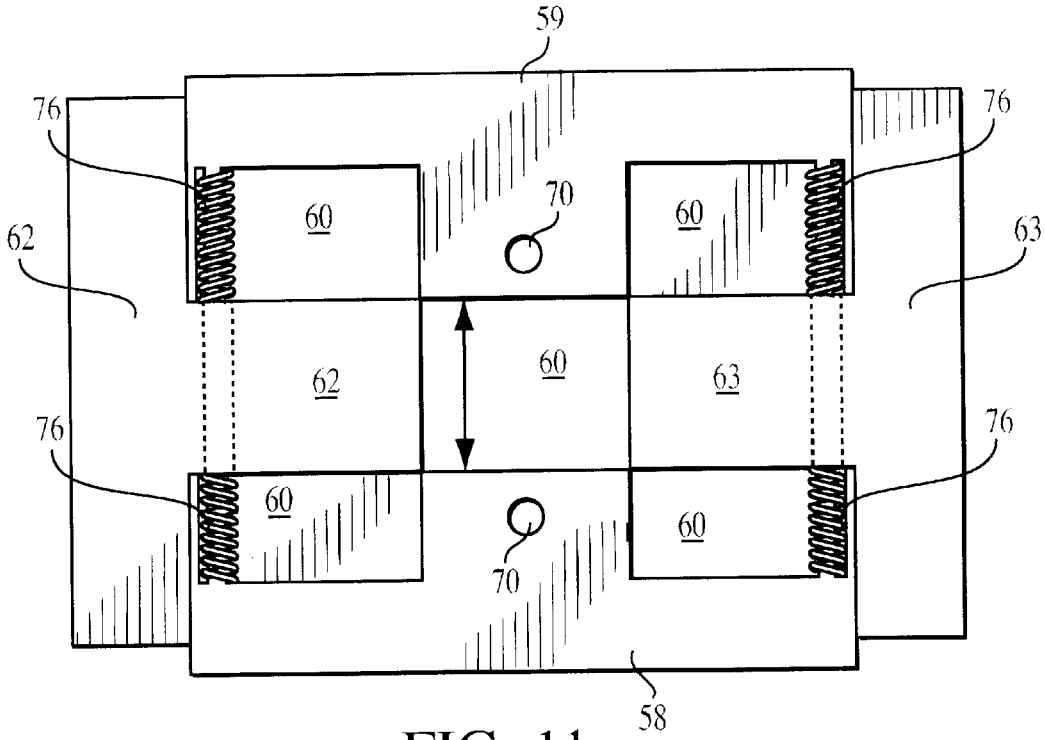
FIG. 11 is a top view of a moveable floor of FIG. 10 with top plate removed to show the base plate including extended springs and extended tabs.
Figure 12:
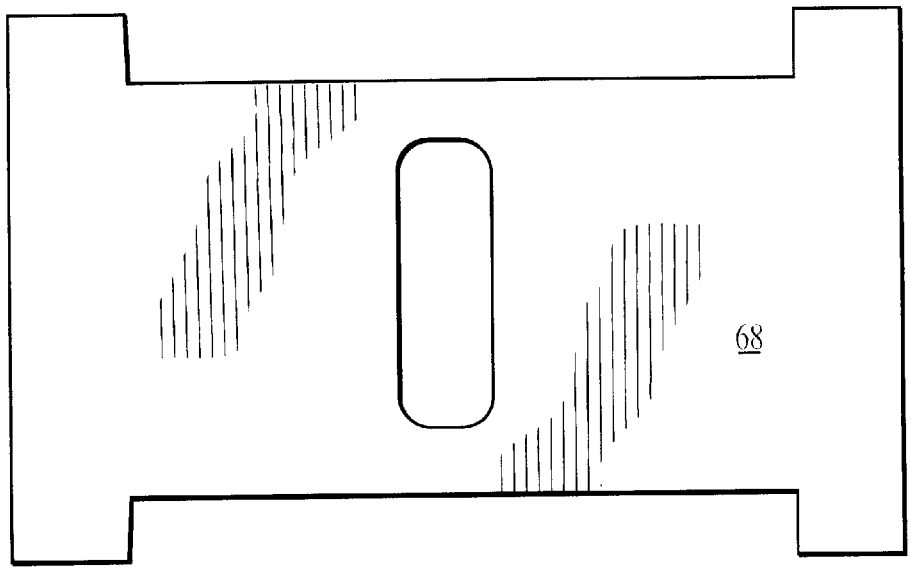
FIG. 12 is a top view of a top plate of the moveable floor of FIG. 10.
Figure 13:
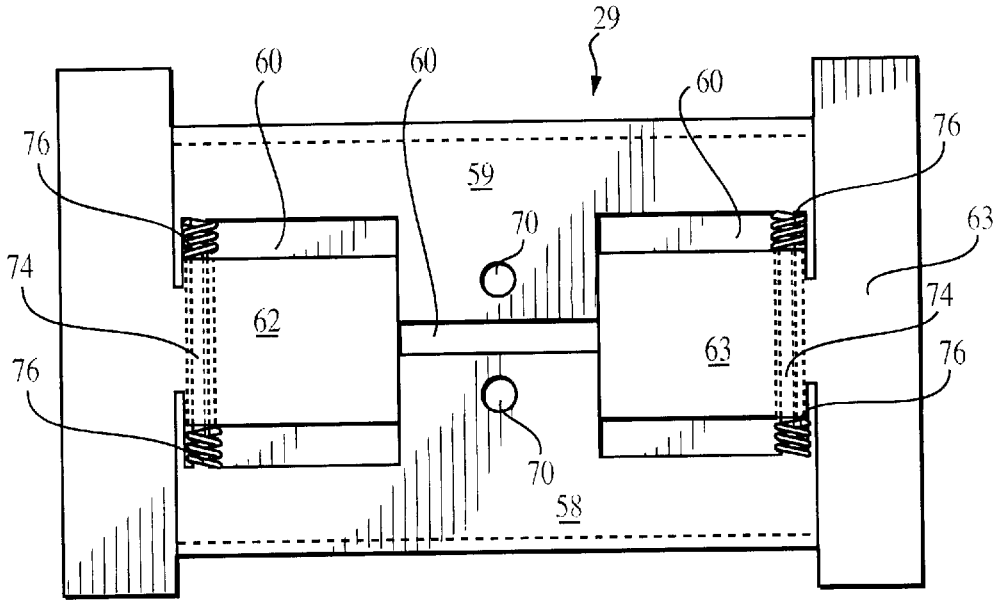
FIG. 13 is a top view of a moveable floor of FIG. 10 with top plate removed to show the base plate including compressed springs and fully retracted tabs.
Figure 14:
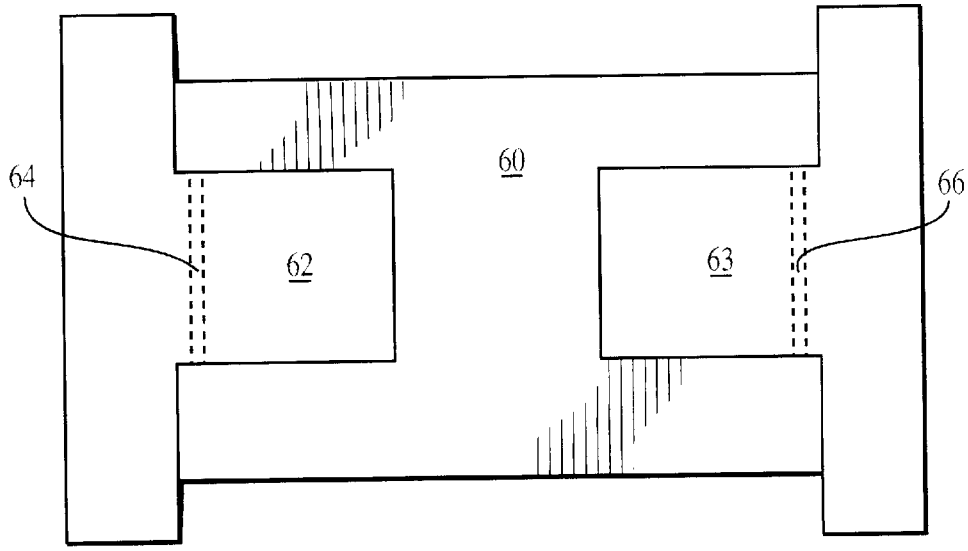
FIG. 14 is a top view of a base plate of the moveable floor of FIG. 10 with spring guide channels shown in phantom.
Figure 15:
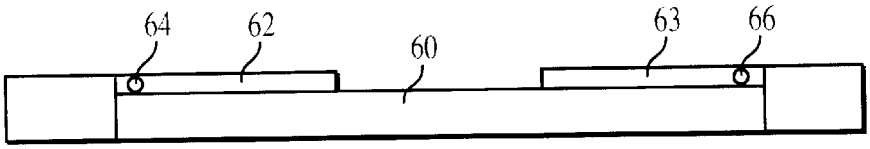
FIG. 15 is a side view of FIG. 14.

As is shown in FIGS. 10–15, each moveable floor member 29, having a width of 8" and a length of 20" comprises a pair of outwardly extending tabs 58 & 59 mounted between a top plate 68 and a base plate 60 . As is shown in FIG. 14 said base plate 60 comprises a pair of blocks 62 & 63, each including a spring guide channel 64 & 66 respectively. Each tab comprises a finger hole tab 70 to be manually accessed for moving said tab between an extended engaged position shown in FIGS. 10 & 11 to a retracted disengaged position, shown in FIG. 13. Tabs 58 & 59 are mounted on a pair of spring shafts 74, each having a coil spring 76 of conventional construction having a size of 1¾"–⅞" for biasing the tab in an extended position as is shown in FIG. 11. Each pair of spring shafts 74 is received in a pair of spring guide channels 64 & 66 provided in blocks 62 & 63.

In operation the finger holes 70 of a moveable floor member 29 are manually grasped between a user's thumb and forefinger, not shown, and urged together to a position shown in FIG. 13 whereby tabs 58 & 59 are retracted inwardly from an extended position to a retracted position, toward the block 62 & 63 and away from a support member such as shelf cleats 51 and 54. In such retracted position the moveable floor member may be easily moved manually from a lower general waste position to an upper medical waste position. As is shown in FIGS. 9 & 10 support for moveable floor members 29 is provided by a upper and lower pair of shelving cleats each consisting of cleats 51 and 54 respectively. The upper pair of shelving cleats is positioned 15¼" from base 78 of disposal receptacle 14 and the lower pair of shelving cleats is positioned 7½" from said base 78 and are integrally formed with receptacle 14 and extend orthogonally from the wall of said receptacle. As is seen in FIG. 10, each moveable floor 29 may be selectably moved between the upper short bag position and a lower, long-bag position or visa versa by accessing the finger holes 70 for manually accessing and selectably moving. As is shown in FIG. 2, the unitary disposal arrangement 10 includes a unitary divider lid member 26 positioned over said cavities which is operated by a foot pedal being hingedly moveable between an open position for receiving trash and a closed position for enclosing said trash.

Referring to FIGS. 2, 9 & 10 the receptacle divider 32 comprises a vertical sandwich member 35 having an interior channel 37 adapted to receive the lid barrier 39 of the unitary lid 26.

The present invention also is directed to a disposal system for use in hospitals and medical facilities for controlling the segregation of multiple classes of waste comprising;

1) receptacle means for segregating the deposit of multiple classes of trash in each room,
2) collection means for segregated collection of the contents of the receptacle means,
3) container means for segregated containment of the segregated contents,
4) color coding means for segregating waste, and
5) barrier means.

What is claimed is:

1. A unitary disposal arrangement for controlling the segregation of multiple classes of waste, one class consisting of medical waste, comprising:

A) a unitary disposal receptacle for use at point of generation of medical waste comprising;
   1) a deposit opening;
   2) at least two uniquely identified and separately divided waste receiving cavities comprising a first cavity and a second cavity, each divided by a common divider, each separately identified by color wherein each color cannot be the same, and each having a moveable floor, moveable between a general waste position and a medical waste position;
   3) the common divider comprising a receptacle divider having an intermediate interior wall member of sandwich construction, having a hollow space for associating with a lid barrier member, for separately dividing the first cavity from the second cavity;
   4) a unitary lid positioned over said deposit opening in hinged relationship with the disposal receptacle, operable by a foot pedal means, for movement between a first closed position and a second open position; comprising a barrier member of planar construction arranged in orthogonal relationship with said lid and extending between said lid and said receptacle divider;
   6) liner means comprising a disposal bag for each cavity, each having a mouth segment for receiving waste objects comprising a first separate disposable bag color coded red for medical waste for the first cavity also color coded the same first color and a second separate disposable bag color coded neutral for recyclable waste for the second cavity color coded neutral for recyclable waste; and
   7) hanger means for receiving the mouth segment of each liner means, said hanger means being formed on the perimeter of the deposit opening; wherein said barrier member provides a barrier in the deposit opening extending between the lid and said receptacle divider between the first cavity and the second cavity as the lid is moved between the closed position to the open position such that at least two classes of waste may be deposited therein without commingling.

2. The unitary disposal arrangement of claim 1 wherein the first cavity includes interior walls and is color coded red for receiving medical waste contained in red bags.

3. The unitary disposal arrangement of claim 1 wherein the second cavity is color coded a neutral color for general waste.

4. The unitary disposal arrangement of claim 1 wherein each moveable floor is moveably supported a pair of shelving cleats and comprises a pair of outwardly extending tabs mounted on spring shafts each having a coil spring for biasing the tab in an extended position, and each tab comprises a finger hole to be manually accessed and compressed for moving said tab between an extended engaged position a retracted disengaged position.

5. The unitary disposal arrangement of claim 1 wherein said intermediate interior wall comprises a vertical sandwich construction includes interior channel adapted to receive the barrier member of the lid divider means.

6. A method for segregating medical waste from general recyclable trash by reinforcing segregation by means of the steps of;

1) providing unitary receptacle means for accepting and segregating the deposit of at least two classes of trash in each room,
2) providing dual compartment means for segregated containment of the segregated contents,
3) providing separate color coding means each compartment,
4) providing collection means for segregated collection of the contents of the receptacle means; and
5) providing a lid connected in hinged relationship with the receptacle means operated by a foot pedal for movement between a first closed position to an open position; comprising a barrier member cooperating with a receptacle divider for providing a barrier in the deposit opening extending between the lid and said receptacle divider between the first cavity and the second cavity as the lid is moved between the closed position to the open position wherein the barrier means provides a barrier between said compartments at the deposit opening throughout the open and closed mode of operation for preventing CO-mingling.

* * * * *